United States Patent [19]

Elwin

[11] 4,064,786

[45] Dec. 27, 1977

[54] METHOD AND DEVICE FOR AUTOMATIC AMMUNITION HANDLING

[75] Inventor: Tore Elwin, Karlskoga, Sweden

[73] Assignee: AB Bofors, Bofors, Sweden

[21] Appl. No.: 654,833

[22] Filed: Feb. 3, 1976

[30] Foreign Application Priority Data

Feb. 19, 1975 Sweden ..... 7501823

[51] Int. Cl.[2] ..... F41F 9/04

[52] U.S. Cl. ..... 89/33 B; 89/33 F; 89/46

[58] Field of Search ..... 89/1.802, 33 B, 36 K, 89/45, 46, 47; 114/1, 5, 6, 7, 8

[56] References Cited

U.S. PATENT DOCUMENTS 2,933,981 4/1960 Anderson et al. ..... 89/45

FOREIGN PATENT DOCUMENTS 966,693 10/1950 France ..... 89/46

*Primary Examiner*—Stephen C. Bentley

*Attorney, Agent, or Firm*—Pollock, Vande Sande & Priddy

[57] ABSTRACT

A plurality of rounds of ammunition are fed simultaneously by the invention which includes a plurality of hoists feeding a plurality of compartments located in a magazine mounted on the elevating part of a gun. Rapid loading in synchronism with firing is thus achieved. A method of loading a compartmented magazine is taught.

3 Claims, 3 Drawing Figures

METHOD AND DEVICE FOR AUTOMATIC AMMUNITION HANDLING

BACKGROUND OF THE INVENTION

The present invention relates to automatic ammunition handling at a gun with feeding of ammunition in synchronism with the rate of fire from a compartmented magazine on the elevating mass of the gun. The ammunition compartments in the magazine are then replenished from an ammunition compartment located below via one or several hoists.

For heavy guns, for instance for naval use, it is desirable to have an ammunition handling system which is as automatic as possible. At the same time as the requirements for a high state of preparedness and capability of essentially continuous firing have increased, desires have also been expressed to reduce gun crew personnel requirements as much as possible. For guns with unmanned turret parts it is easier to provide complete protection for the crew during battle conditions. Moreover there will be fewer risks involved for personnel due to toxic powder gasses that can be formed in the turret part. A further essential advantage is that an unmanned turret part can be given smaller dimensions. In previously known automatic ammunition handling systems of the type used for heavy naval guns, the ammunition is transported from the ammunition compartment to the gun in synchronism with the rate of fire. However, this mode of operation places severe design requirements on the hoists. Rounds which are transported up from the ammunition compartment to the traversable portion of the gun with the aid of a hoist must be conveyed with the longitudinal axis of the round parallel to the traversing axis of the gun. This, however, requires that the speed of the hoist be high, since between two consecutive firings, the rounds must be hoisted a longer distance than the length of a complete round of ammunition. If ammunition transport in synchronism with the rate of fire is to be used, the rounds preferably should be transported with their direction of movement at right angles to their longitudinal axes to reduce transport time. If the rounds are moved in this manner, however, it becomes rather difficult to transfer the ammunition from the ammunition compartment or other fixed portion of the gun to its traversable portion.

OBJECTS AND SUMMARY OF THE INVENTION

The purpose of the present invention is to provide a method and an apparatus of handling communication which eliminates the above-mentioned disadvantages in a simple and cheap way. According to the method of the invention, the gun is set at a certain loading position for replenishing of the magazine. The hoists then transport the ammunition from a feeding device in the ammunition compartment upward and directly into a compartmented magazine on the elevating portion of the gun. The advantage of such a system is that the replenishment of the magazine can take place entirely automatically, without the use of any pendulums or rotating drums, which have previously been necessary for transferring the rounds from the hoist drum. In a preferred embodiment of the invention, the lowermost positions for rounds in the magazine located on the elevating portion of the gun are held vertical in a vertical orientation while the gun is in the loading position, so that they form a direct continuation of a hoist drum corresponding to each ammunition compartment in the magazine.

BRIEF DESCRIPTION OF THE DRAWING

In the following, the invention will be described with reference to the accompanying drawings, in which FIG. 1 schematically shows a view in perspective of the automatic ammunition handling system in the loading position.

DETAILED DESCRIPTION OF THE PREFERRED EMBODIMENT

Figure 1:
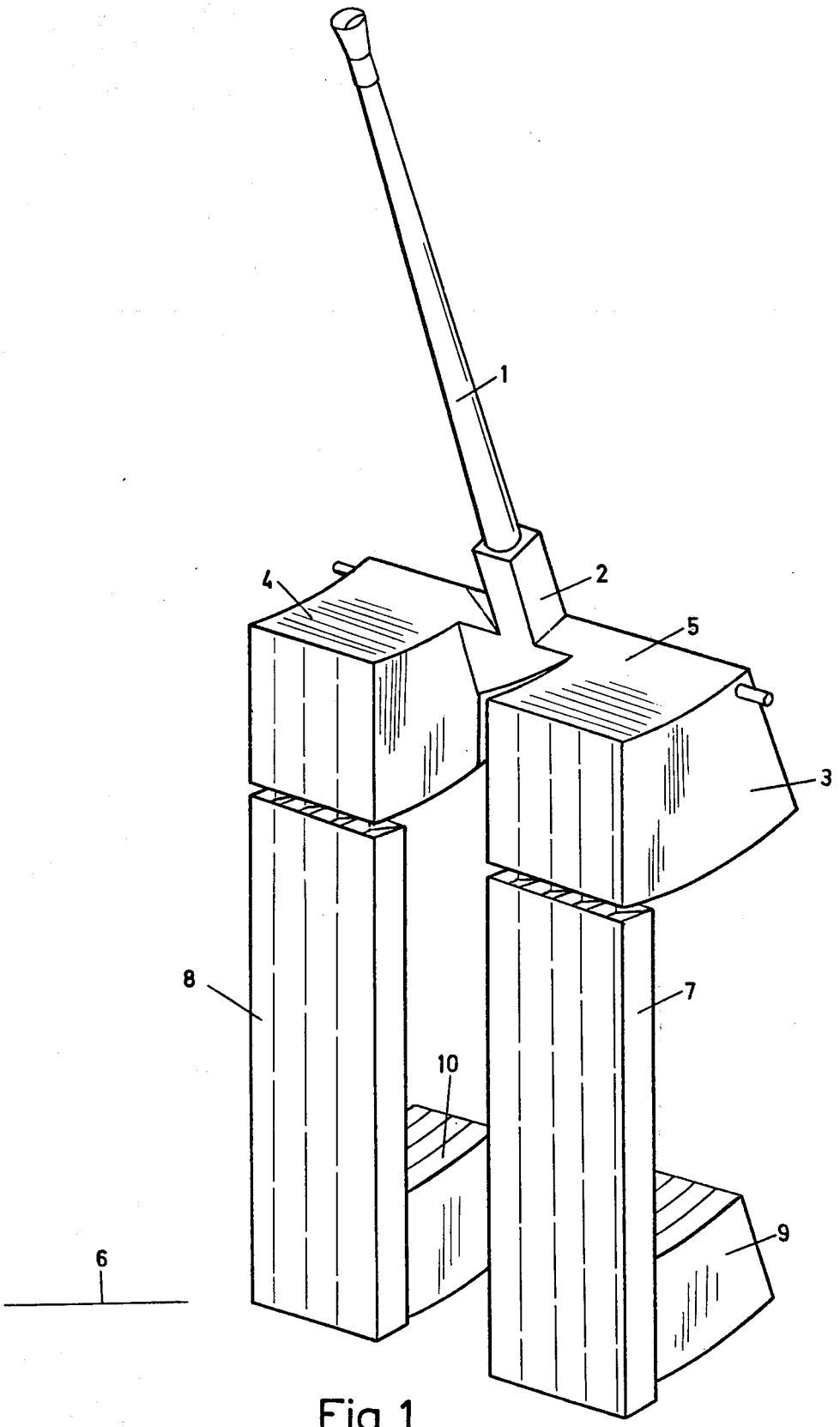

FIG. 1 shows schematically a view in perspective of an automatic ammunition handling system for a heavy gun suitable for installation on a naval vessel, for instance a naval dual purpose gun; but such a gun may also be arranged on a stationary platform. The elevating mass or portion of the gun comprises a barrel 1, a recoil jacket 2 and a magazine in the form of two magazine halves 3 and 4 fixed to recoil jacket 2 of the weapon. The elevating mass is arranged so that it can turn around an elevation axis 5. As more clearly shown in FIGS. 2 and 3, each magazine half 3 and 4 is divided up into compartments which are substantially vertical as viewed in FIG. 1. From these compartments, the rounds of ammunition are fed to a feeding table, not shown, which moves the rounds into a ramming position for the weapon. The replenishment openings of the compartments of the magazine are directed downwards as viewed in FIG. 6 whereby the major portion of the magazine will be located below the elevation mass axis 5. This location is an advantage since the gun can thereby be given a comparatively low profile. Replenishment compartments of magazine halves 3, 4 takes place from the ammunition compartment 6 (see FIG. 2) via two hoists 7, 8, which are ship-fixed. Ammunition is delivered to hoists 7, 8 by automatic feeding devices 9, 10 in the ammunition compartment. Hoists 7, 8 then lift the ammunition up to and directly into the compartments of magazine halves 3, 4 on the elevating mass. Each hoist 7, 8 is shown with four side-by-side hoist drums, each having a fan-shaped feeding device 9, 10, for replenishment of the hoists. The structural details of the hoist transport, which may be conventional rod hoists, do not constitute a part of the present invention, and therefore will not be described in detail. The feeding devices are driven from the same driving machinery as the hoist rods.

Replenishment of the two feeding devices 9 and 10 takes place preferably manually by two loaders, and is carried out at suitable pauses in the firing. Alternatively, the automatic feeding devices can be made larger, so that the whole of the ammunition store can be contained in these. No loaders are then needed for the ammunition handling, and this can then take place entirely automatically.

In FIG. 1, the gun is shown set in its loading position, for instance 30° in elevation and 0° in traverse, the lowermost positions for rounds in the compartments of magazine halves 3, 4 then being vertical and forming a direct continuation of the hoist drum corresponding to each ammunition compartment. Four rounds can thereby be hoisted in parallel and inserted in the replenishment openings of the magazine. The rounds located in the compartments of magazine halves 3,4 are thereafter fed one step into their respective compartments, after which each magazine half is ready for filling in four more rounds. The loading cycle is repeated until each magazine half has been completely filled. Each hoist drum with feeding device should appropriately hold as many rounds as are required for a reloading of an empty magazine. The loading procedure — setting the gun at the previously described loading position, loading and return to firing position — takes place automatically at a loading command from the fire control center.

Figure 2:
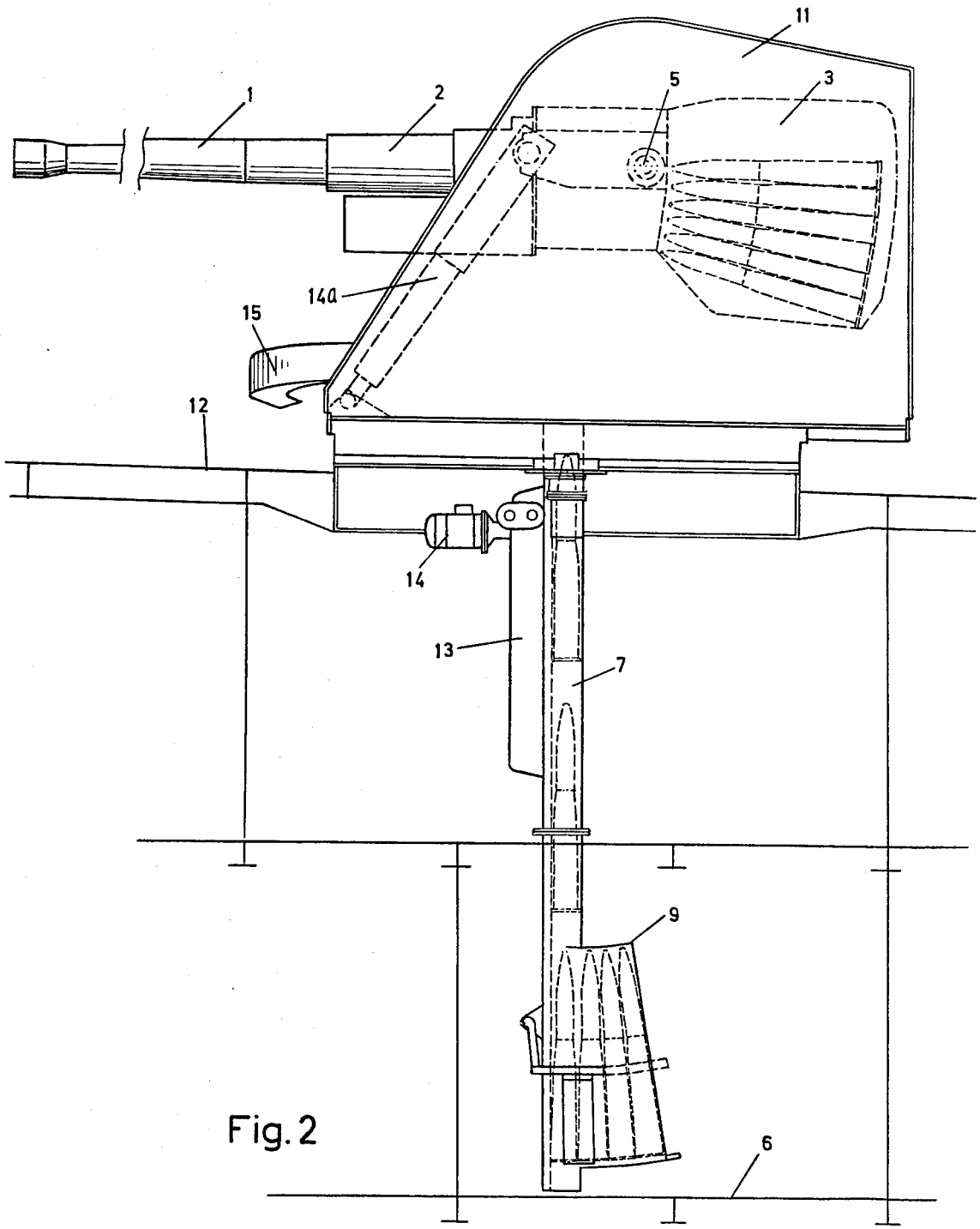
FIG. 2, a side view of the system in the firing position.

FIG. 2 shows a side view of the automatic ammunition handling system after the gun has been loaded and has returned to its firing position. In FIG. 2, the same reference designations have been used as in FIG. 1 for the same parts of the invention. As will be noted from FIG. 2, the traversable part of the gun comprises an unmanned turret part 11 with a comparatively low profile, placed on a platform 12 directly above the ammunition compartment 6. From FIG. 2 it will be noted how the rounds are transported in their longitudinal direction in the hoist drum 7 from the feeding device 9. Driving takes place with the aid of a hoist machinery 13 with a motor 14. The elevating mass of the gun, comprising the barrel 1, the recoil jacket 2 and the magazine 3 is arranged to be turned around the axis 5 with the aid of a hydraulic piston 14*a*. A cartridge case deflector 15 has also been indicated.

As will be noted from FIG. 1, the ammunition handling system consists of two symmetrically located subsystems. These normally each handle one kind of ammunition, so that during firing, only the system on either the right or the left side need be in operation. Changing of the type of ammunition, e.g. from surface-target ammunition to antiaircraft ammunition, takes place rapidly, and is achieved simply by switching from the ammunition handling system on one side to the system on the other side.

Figure 3:
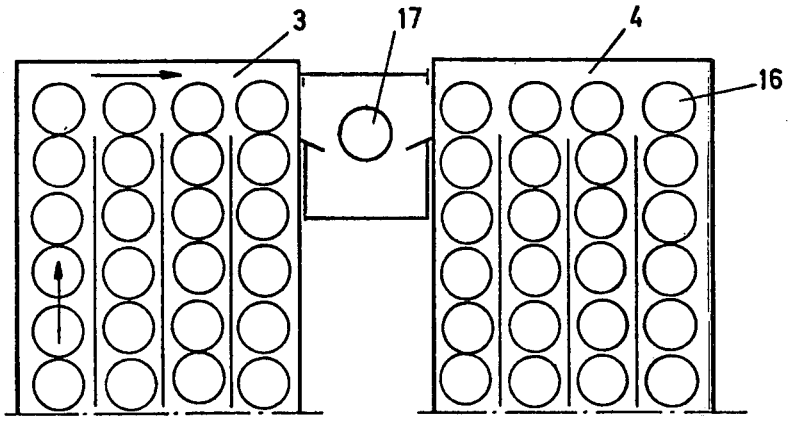
FIG. 3, a view from the rear, showing the feeding of ammunition from the compartmented magazine when firing.

The feed of ammunition from the two magazine halves 3, 4 in synchronism with the rate of fire is easily understood from FIG. 3, which shows a view from the rear of the two magazine halves. Each magazine half comprises four side-by-side ammunition compartments which are directed downwards in the firing position with the rounds pointing in the direction of barrel 1. In each ammunition compartment, the ends of the cartridge cases of six rounds 16 have been indicated. When firing, the rounds are fed horizontally from the ammunition compartments into the ramming position of the gun, which has been designated 17, and from which ramming can take place by means of a rammer, not shown. Vertical feeding in the compartments does not take place until the uppermost rounds in all four compartments have been fed to ramming position 17. As vertical feeding is to be carried out only after every four rounds, and all of the rounds in the magazine are then to be raised one step, the recoil energy of the gun cannot be utilized for the vertical feed movement. This is therefore achieved with the aid of two hydraulically driven feeders not shown. On the other hand, the transverse feed of rounds to ramming position 17 can appropriately be recoil-driven, in a conventional way. The advantage of having the vertical feed of all four rounds in the magazine take place simultaneously is that all four compartments will require the same replenishment, so that reloading can take place with an ammunition replenishing device which simultaneously inserts one round in each compartment of the magazine.

I claim:

1. Apparatus for handling rounds of ammunition for a gun, said gun being mounted for movement about a horizontal elevation axis, to load said gun in synchronism with the rate of fire of said gun, comprising:

at least one ammunition magazine located on and movable with said gun about said axis, said magazine having a plurality of side-by-side, essentially vertically extending compartments spaced laterally from said gun said compartments having upper and lower portions, said upper portion of each said compartment being located to permit horizontal feed of rounds first from said upper portion of the compartment located closest to said gun into said gun and then sequentially from said upper portions of the remaining compartments, said lower portions of said compartments being adapted to simultaneously receive a corresponding plurality of rounds during loading;

at least one ammunition compartment located below and fixed relative to said gun;

a plurality of side-by-side hoist means located in said at least one ammunition compartment for lifting a plurality of ammunition rounds with the axis of said rounds substantially parallel to the direction of movement from said at least one ammunition compartment and simultaneously depositing them in said lower portions of a corresponding plurality of said side-by-side compartments; and means for rotating said gun about said horizontal elevation axis to a loading position in which said lower portions of said plurality of side-by-side compartments are oriented for simultaneously receiving said plurality of ammunition rounds direct from said plurality of side-by-side hoist means.

2. Apparatus according to claim 1, wherein said hoist means move said rounds with their axes in the vertical direction and said plurality of side-by-side compartments is oriented in said loading position to receive simultaneously rounds moving from said hoist means in said vertical direction.

3. Apparatus according to claim 1, wherein said ammunition magazine is divided into two halves, one mounted on each side of the gun, each half having replenishment openings in said lower portions for simultaneously receiving a plurality of rounds directly from said plurality of side-by-side hoist means.

* * * * *